US009480901B2

(12) United States Patent
Orenstein et al.

(10) Patent No.: US 9,480,901 B2
(45) Date of Patent: Nov. 1, 2016

(54) TRUNK LIFT DEVICE

(71) Applicant: The Prophet Corporation, Owatonna, MN (US)

(72) Inventors: Amber Orenstein, Prior Lake, MN (US); Caleb Summers, St. Louis Park, MN (US); Randy C. Peterson, Victoria, MN (US); Jason J. Ness, Victoria, MN (US)

(73) Assignee: The Prophet Corporation, Owatonna, MN (US)

( * ) Notice: Subject to any disclaimer, the term of this patent is extended or adjusted under 35 U.S.C. 154(b) by 251 days.

(21) Appl. No.: 14/341,303

(22) Filed: Jul. 25, 2014

(65) Prior Publication Data

US 2016/0023052 A1 Jan. 28, 2016

(51) Int. Cl.

| | |
|---|---|
| ***A63B 71/06*** | (2006.01) |
| *A63B 21/068* | (2006.01) |
| *A63B 23/02* | (2006.01) |

(52) U.S. Cl.

CPC ..... *A63B 71/06* (2013.01); *A63B 21/068* (2013.01); *A63B 23/0211* (2013.01); *A63B 23/0233* (2013.01); *A63B 2220/20* (2013.01)

(58) Field of Classification Search

CPC ..... G01B 3/10; G01B 3/20; G01B 3/22; A61B 5/103; A61B 5/107

USPC ..... 33/511, 512

See application file for complete search history.

(56) References Cited

U.S. PATENT DOCUMENTS

| | | | | |
|---|---|---|---|---|
| 2,536,625 | A * | 1/1951 | Button | G01B 3/20 33/838 |
| 2,850,804 | A * | 9/1958 | Massari | B43L 7/005 33/26 |
| 5,188,121 | A * | 2/1993 | Hanson | A61B 5/1071 33/512 |
| 5,303,480 | A * | 4/1994 | Chek | A61B 5/103 33/512 |
| 5,579,585 | A * | 12/1996 | Schaeffer | G01C 15/00 33/286 |
| 6,301,799 | B1 * | 10/2001 | Ho | A61B 5/1075 33/512 |
| 6,754,970 | B2 * | 6/2004 | Daniels | A63B 60/42 33/508 |
| 7,200,952 | B2 * | 4/2007 | Montagnino | A61B 5/0537 33/512 |
| 7,543,395 | B2 * | 6/2009 | Silberman | G01B 3/08 33/832 |
| 8,387,266 | B2 * | 3/2013 | Eddy | A61H 9/0078 33/512 |
| 8,926,532 | B2 * | 1/2015 | Barrett | A61B 5/1071 33/511 |
| 2002/0092191 | A1 * | 7/2002 | Hauzie, Jr. | G01B 5/25 33/529 |
| 2010/0005675 | A1 * | 1/2010 | Gerster | A61B 5/1072 33/512 |
| 2011/0179663 | A1 * | 7/2011 | Kang | A61B 5/1072 33/759 |
| 2015/0211834 | A1 * | 7/2015 | Dalquist | G01B 3/1084 33/760 |
| 2016/0023052 | A1 * | 1/2016 | Orenstein | A63B 71/06 33/701 |

* cited by examiner

*Primary Examiner* — Yaritza Guadalupe-McCall
(74) *Attorney, Agent, or Firm* — Merchant & Gould P.C.

(57) ABSTRACT

A trunk lift assessment device includes a tower extending upwardly from a base; an arm extending outwardly from the tower, a gauge disposed at the tower, and an indicator coupled to the first end of the arm so that the indicator moves relative to the gauge when the arm is pivoted relative to the tower. The arm is configured to remain fixed relative to the tower when no external force is applied to the second end of the arm. The arm also is configured to pivot relative to the tower when an external force is applied to the second end of the arm.

21 Claims, 11 Drawing Sheets

TRUNK LIFT DEVICE

BACKGROUND

Physical fitness is important for a healthy lifestyle. Accordingly, schools assess the physical fitness of their students (e.g., by participating in the President's Challenge). Trunk lifts can be performed during such assessments. Conventionally, teachers or other designated testers used hand held rulers or other such instruments to determine the height of the trunk lift being performed. Observing each student perform the trunk lift can be time consuming.

Improvements are desired.

SUMMARY

In accordance with aspects of the disclosure, a trunk lift assessment device includes a base configured to seat on a surface; a tower extending upwardly from the base; an arm extending outwardly from the tower; a push member attached to a second end of the arm; a gauge disposed at the tower; and an indicator coupled to a first end of the arm so that the indicator moves relative to the gauge when the arm is pivoted relative to the tower. The arm is configured to remain fixed relative to the tower when no external force is applied to the second end. The arm also is configured to pivot relative to the tower about a pivot axis when an external force is applied to the second end. The pivot axis extends through the intermediate portion of the arm.

In certain examples, the distance markers of the gauge include a starting position and the distance markers increment as the gauge extends towards the base.

In certain examples, the gauge is configured to move relative to tower to adjust a relationship between the starting position and a starting distance between the push member and the surface. In an example, the gauge is configured to slide relative to the tower.

In certain examples, the gauge limits a distance over which the indicator is able to travel during use, thereby limiting a distance the arm is able to pivot during use.

In certain examples, the indicator is pivotally coupled to first end of arm. In an example, the first end of the arm includes a lateral bar; the indicator defines a slot through which the lateral bar extends; the indicator pivots relative to the first end of the arm about the lateral bar; and the bar slides along the slot to enable the first end of the arm to pivot relative to the tower while enabling the indicator to slide relative to the tower.

In certain examples, the indicator includes guide members that slide along a guide channel defined by the tower to guide the indicator as the indicator is moved relative to the tower.

In certain examples, a spring biases the first end of the arm towards the base.

In certain examples, a second arm extends outwardly from the tower generally parallel with the first arm. In an example, the second arm cooperates with the arm to maintain an engagement surface of the push member generally horizontal. In an example, the second arm is pivotally coupled to the tower at a second pivot axis, which is disposed rearwardly of a pivot axis of the arm. In an example, a distance between the arm and the second arm changes as the arm and the second arm pivot relative to the tower. In an example, a tensioning knob enables adjustment of a tension force applied to the arm second arm to retain the second arm in position relative to the tower.

In certain examples, the push member defines a flat bottom surface.

In certain examples, a stabilizer bar that extends outwardly from the base along the surface. In an example, the stabilizer bar extends generally parallel to the base.

In certain examples, the tower is removably coupled to the base.

In certain examples, the arm extends outwardly from a front of the tower and the gauge is disposed at a rear of the tower.

In accordance with other aspects of the disclosure, a method of assessing a trunk lift using a trunk lift assessment device includes: pivoting an arm relative to a tower until a push member coupled to the arm aligns with a top of a head of a user that is lying prone on a surface; moving a gauge relative to the tower until an indicator coupled to the arm aligns with a zero position marker on the gauge; instructing the user to perform a trunk lift so that the head of the user pushes the push member away from the surface, thereby causing the arm to pivot relative to the tower and thereby causing the indicator to move relative to the gauge; allowing the user to move the head of the user back towards the surface; and determining a position marker of the gauge with which the indicator aligns.

In certain examples, the method also includes providing a stabilizer bar extending outwardly from a base to which the tower is coupled; and positioning a mat over the stabilizer bar adjacent the base, the mat defining the surface on which the user is lying prone.

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts upon which the embodiments disclosed herein are based.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Figure 1:
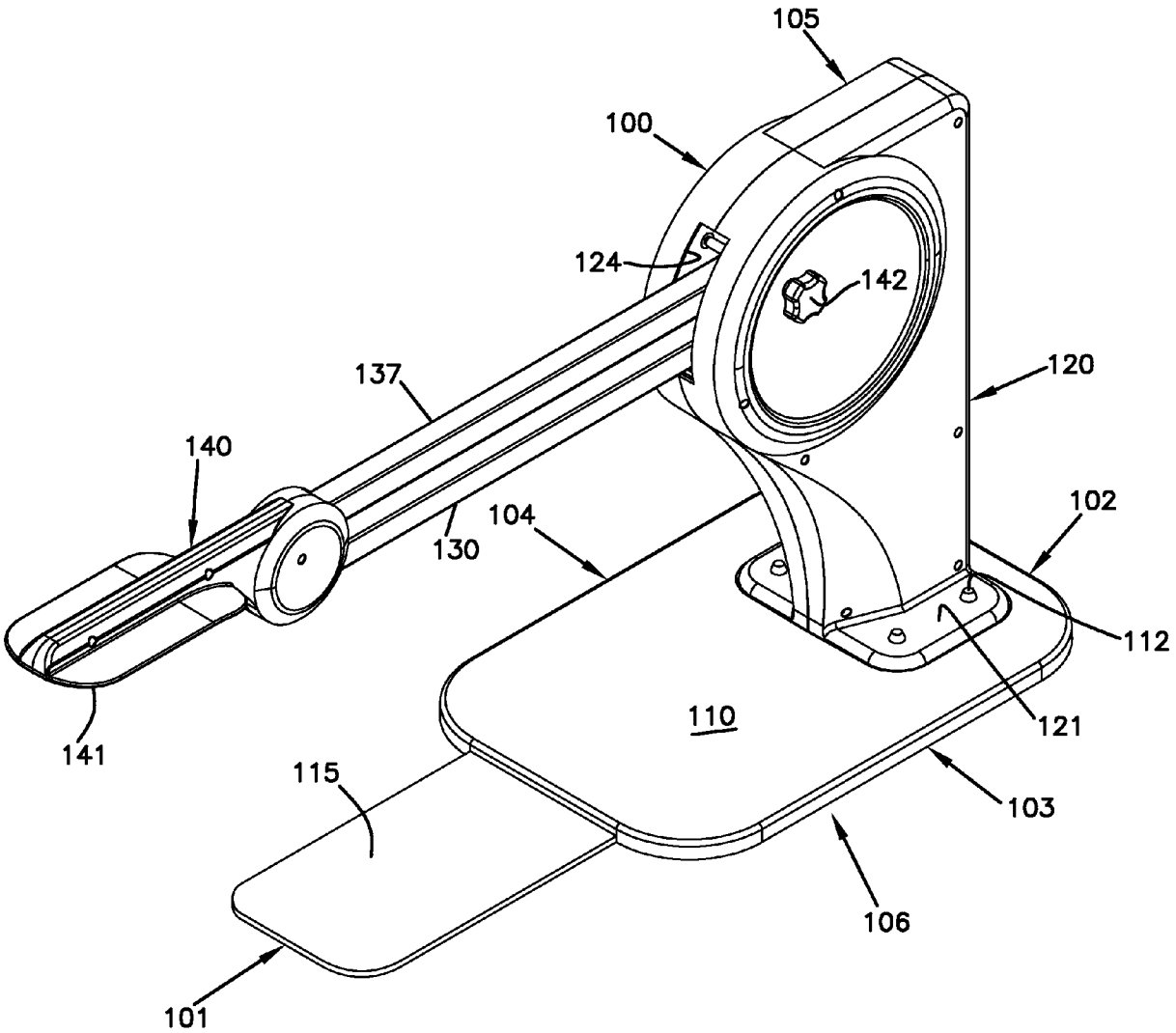
FIG. 1 is a front perspective view of an example trunk lift device.
Figure 2:
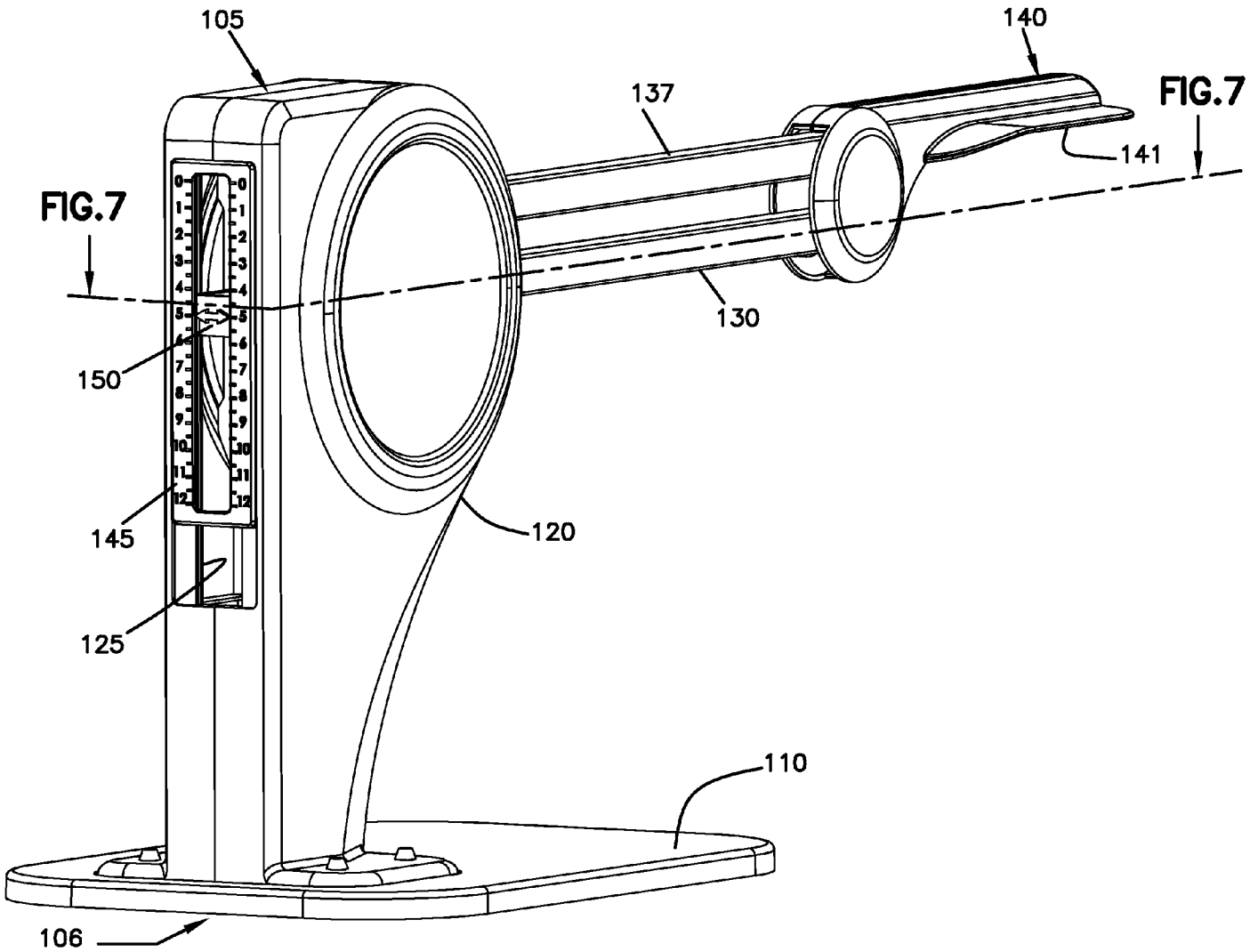
FIG. 2 is a rear perspective view of the trunk lift device of FIG. 1.
Figure 3:
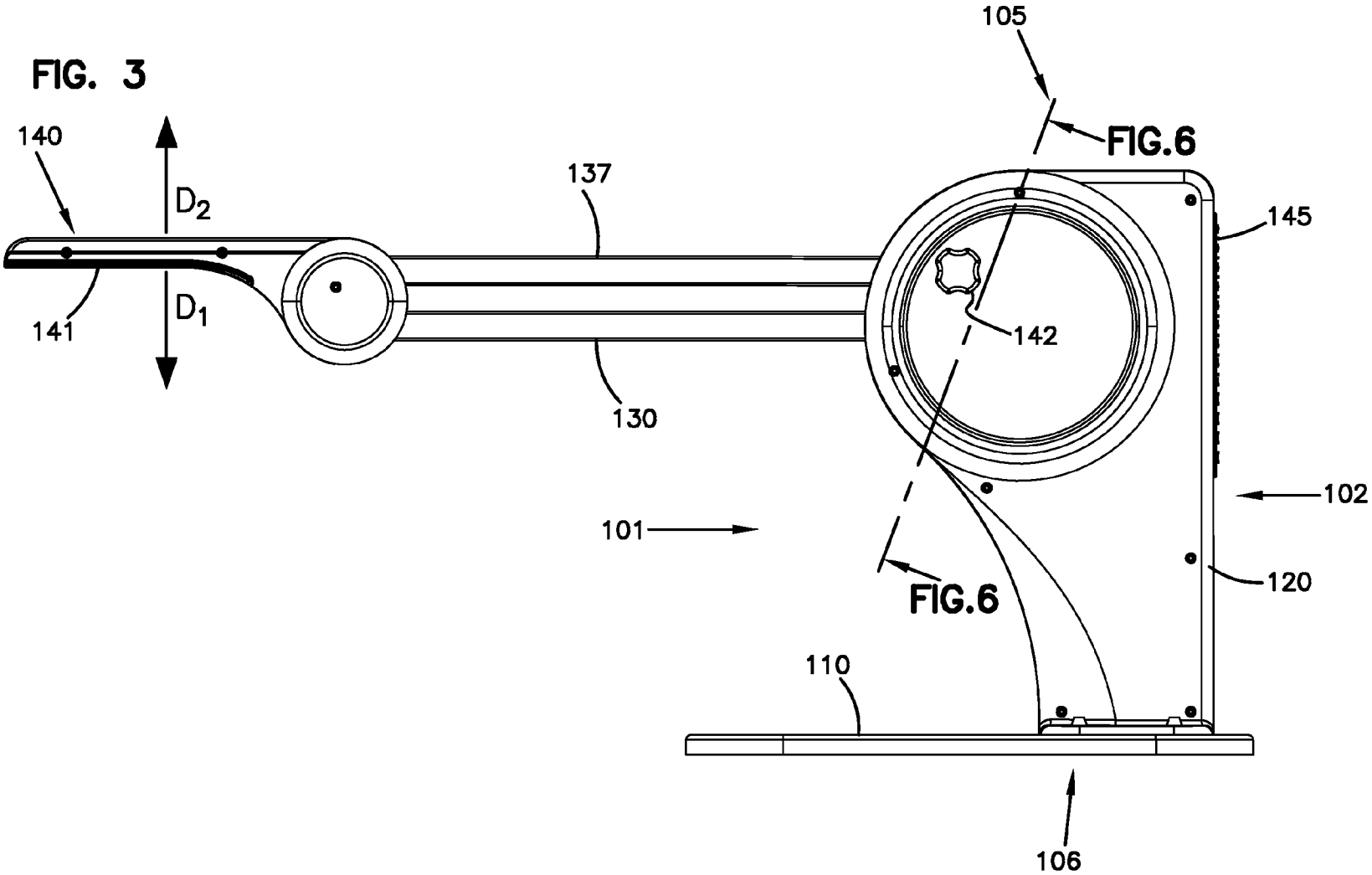
FIG. 3 is a side elevational view of the trunk lift device of FIG. 1.
Figure 4:
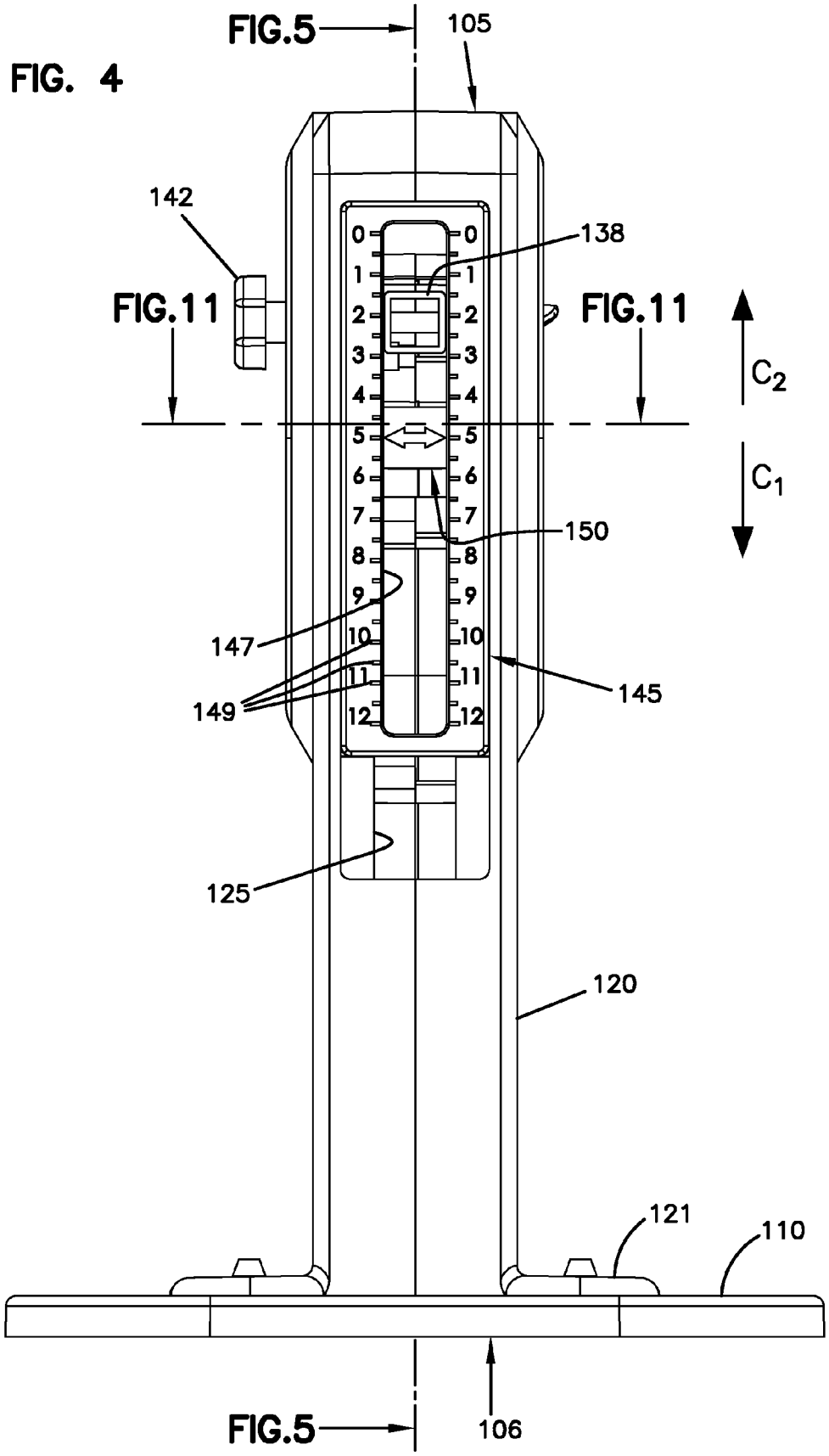
FIG. 4 is a rear elevational view of the trunk lift device of FIG. 1.

Reference will now be made in detail to exemplary aspects of the present disclosure that are illustrated in the accompanying drawings. Wherever possible, the same reference numbers will be used throughout the drawings to refer to the same or like parts.

In general, the disclosure relates to a device suitable for facilitating exercise and/or facilitating assessment of a trunk lift of a user. In particular, the device measures the distance a head of the user moves during a trunk lift. The device continues to indicate the distance after the user has returned to a prone or starting position.

FIGS. 1-4 illustrate an example trunk lift device 100 having a front 101, a rear 102, a first side 103, a second side 104, a top 105, and a bottom 106. The trunk lift device 100 includes a base 110, a tower 120 coupled to the base 110, a first arm 130 extending outwardly from the tower 120, and a push member 140 coupled to a free end of the first arm 130. A gauge 145 is disposed on the tower to provide position markers 149. An indicator 150 is coupled to the first arm 130 to move along the gauge 145 during movement of the push member 140 and to align with one of the position markers 149 to indicate a distance traveled by the push member 140.

In use, the trunk lift device 100 is positioned next to a mat, pad, or other surface on which a user will lie prone. In certain implementations, a stabilizer bar 115 extending outwardly from the base 110 can be disposed beneath the mat or pad. In other implementations, the user can lie on the same surface on which the device 100 seats. The push member 140 is adjusted so that an engagement surface 141 of the push member 140 aligns with a top of the user's head. The gauge 145 is adjusted so that the indicator 150 points to a "zero" position (i.e., a starting position).

The user performs a trunk lift, which causes the user's head to push the push member 140 upwardly. As the push member 140 moves upwardly, the first arm 130 pivots relative to the tower 120. The first arm 130 moves the indicator 150 relative to the gauge 145 from the zero position to another position. The push member 140 is retained in position relative to the tower 120 even after the user ends the trunk lift (e.g., returns to the prone position). The gauge 145 is read to determine with which position marker 149 the indicator 150 aligns. Each position marker 149 indicates a distance over which the push member 140 travels.

Still referring to FIGS. 1-4, the base 110 is configured to seat on a surface (e.g., a floor). In certain implementations, a stabilizer bar 115 extends outwardly from the base 110. In examples, the stabilizer bar 115 is fixedly mounted to the base 110 (e.g., by fasteners, adhesive, or otherwise). In certain implementations, the stabilizer bar 115 is thinner than the base 110. In certain implementations, the stabilizer bar 115 extends outwardly at least as far as the first arm 130. In certain examples, the stabilizer bar 115 extends outwardly at least as far as the push member 140.

The tower 120 is removably coupled to the base 110. In the example shown, the base 110 includes upwardly extending mounting posts 112 and the tower 120 includes a mounting flange 121 defining fastener apertures 122 through which the mounting posts 112 extend. In other examples, the tower 120 can define the mounting posts and the base 110 can define the fastener apertures. In still other examples, the tower 120 can be otherwise coupled to the base 110. In some implementations, a bottom of the tower 120 can be weighted to aid in retaining the tower 120 in position at the base 110. In certain examples, the base 110 defines a recess 111 (see FIG. 1) in which the mounting flange 121 of the tower 120 seats. In the example shown, the base 110 includes a raised pad 113 that extends upwardly from the recess 111 and into the tower 120 to further aid in retaining the tower 120 in position at the base 110.

Figure 5:
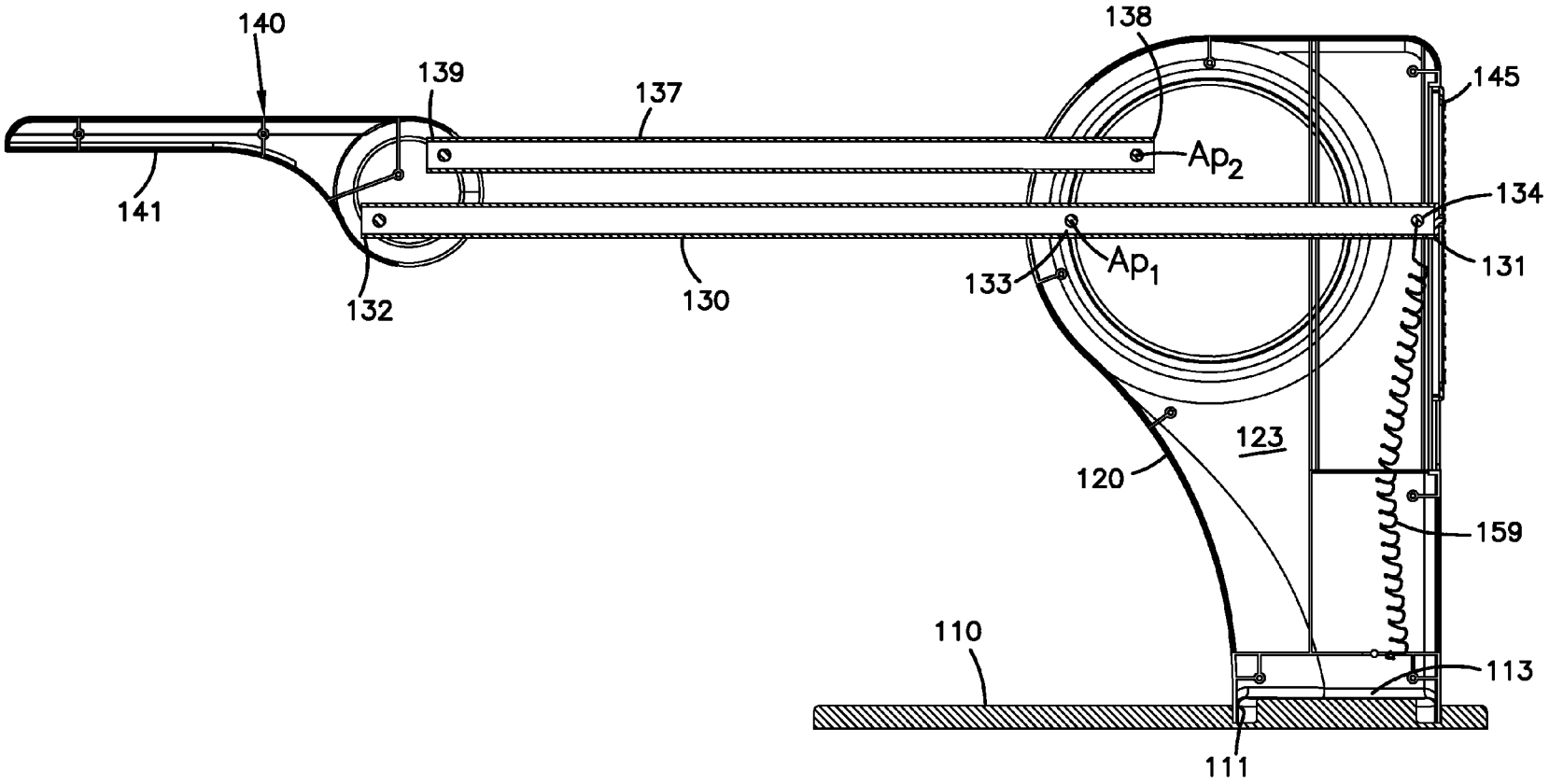
FIG. 5 is a cross-sectional view of the trunk lift device of FIG. 1 taken along the 5-5 line of FIG. 4.

As shown in FIG. 5, the first arm 130 extends from a first end 131 to a second end 132. An intermediate portion 133 is located between the first and second ends 131, 132. The indicator 150 is coupled to the first arm 130 at the first end 131. The first arm 130 is coupled to the tower 120 at the intermediate portion 133 and extends outwardly from the tower 120 through a front slot 124. The push member 140 is coupled to the first arm 130 at the second end 132. The first arm 130 pivots relative to the tower 120 about a pivot axis $A_{P1}$ that extends through the intermediate portion 133. The first arm 130 moves along the front slot 124 while being pivoted.

A second arm 137 also can be coupled to the tower 120. The second arm 137 extends from a first end 138 to a second end 139. The second arm 137 also pivots relative to the tower 120 about a second pivot axis $A_{P2}$ that extends through the first end 138 of the second arm 137. The second arm 137 is shorter than the first arm 130. In certain examples, the second arm 137 is positioned above the first arm 130. In certain examples, the pivot axis $A_{P2}$ of the second arm 137 is positioned more rearwardly than the pivot axis $A_{P1}$ of the first arm 130. In certain examples, the second arm 137 extends generally in parallel with the first arm 130. In certain examples, as the arms 130, 137 are pivoted relative to the tower 120, a distance between the arms 130, 137 changes while the arms 130, 137 are maintained in parallel.

The push member 140 is coupled to the second end 139 of the second arm 137. Accordingly, the push member 140 can be moved generally downwardly in a first direction D1 or generally upwardly in a second direction D2 by pivoting the first arm 130 (see FIG. 3). In some implementations, the first and second arms 130, 137 couple to the push member 140 so as to cause an engagement surface 141 of the push member 140 to extend generally horizontally regardless of the position of the first arm 130. For example, in certain implementations, the second arm 137 pivotally couples to the push member 140 at a location rearward of where the first arm 130 pivotally couples to the push member 140. Accordingly, the user consistently pushes against the engagement surface 140 throughout the trunk lift. In some implementation, the engagement surface 141 of the push member 140 is generally flat. In other implementations, the engagement surface 141 of the push member 140 is contoured to comfortably fit a head of a user. In the example shown, the push member 140 has a paddle shape extending from a mounting section.

Figure 6:
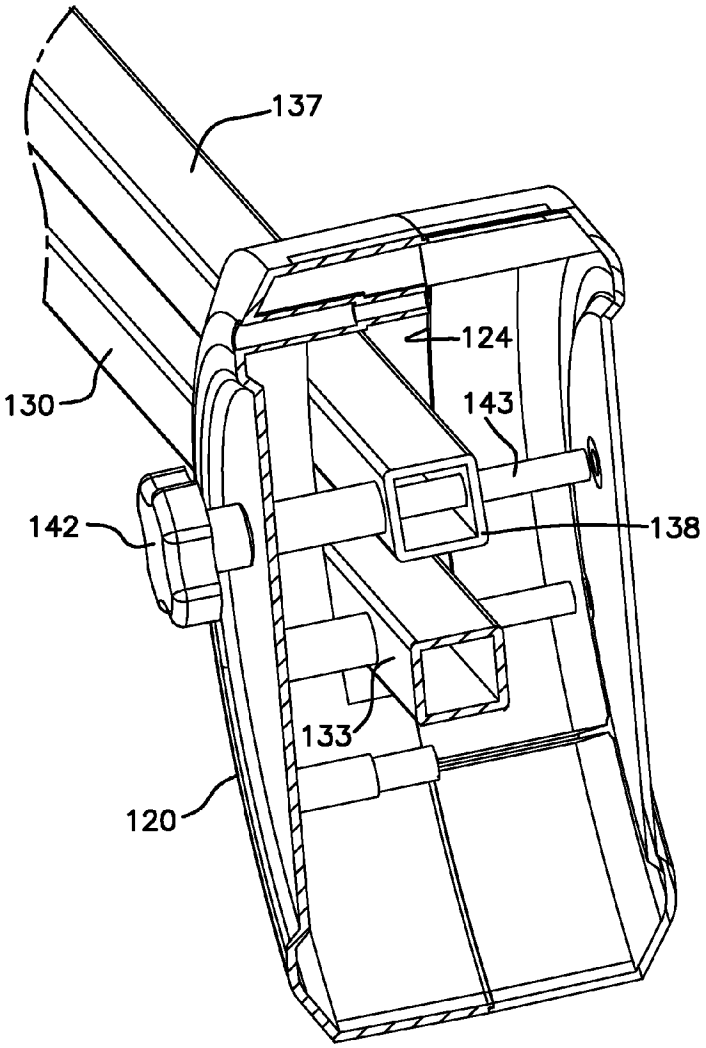
FIG. 6 is a partial cross-sectional view of the trunk lift device of FIG. 1 taken along the 6-6 line of FIG. 3.

As shown in FIG. 6, a tensioning knob 142 can be disposed at the tower 120 to increase or decrease tension applied to the second arm 137. For example, the tensioning knob 142 can be coupled to the hinge pin 143 about which the first end 138 of the second arm 137 pivots. The hinge pin 143 extends inwardly from the tower 120 and through the second arm 137. In certain examples, the hinge pin 143 includes a threaded surface that engages an interior fastener opening of the tower 120. Tightening the tensioning knob 142 applies or increases a force (e.g., a friction force) between the tower interior structure and the second arm 137, thereby inhibiting movement of the second arm 137 (and hence the push member 140) relative to the tower 120. Loosening the tensioning knob 142 mitigates or removes the force, allowing the second arm 137 (and hence the push member 140) to pivot more freely.

Figure 7:
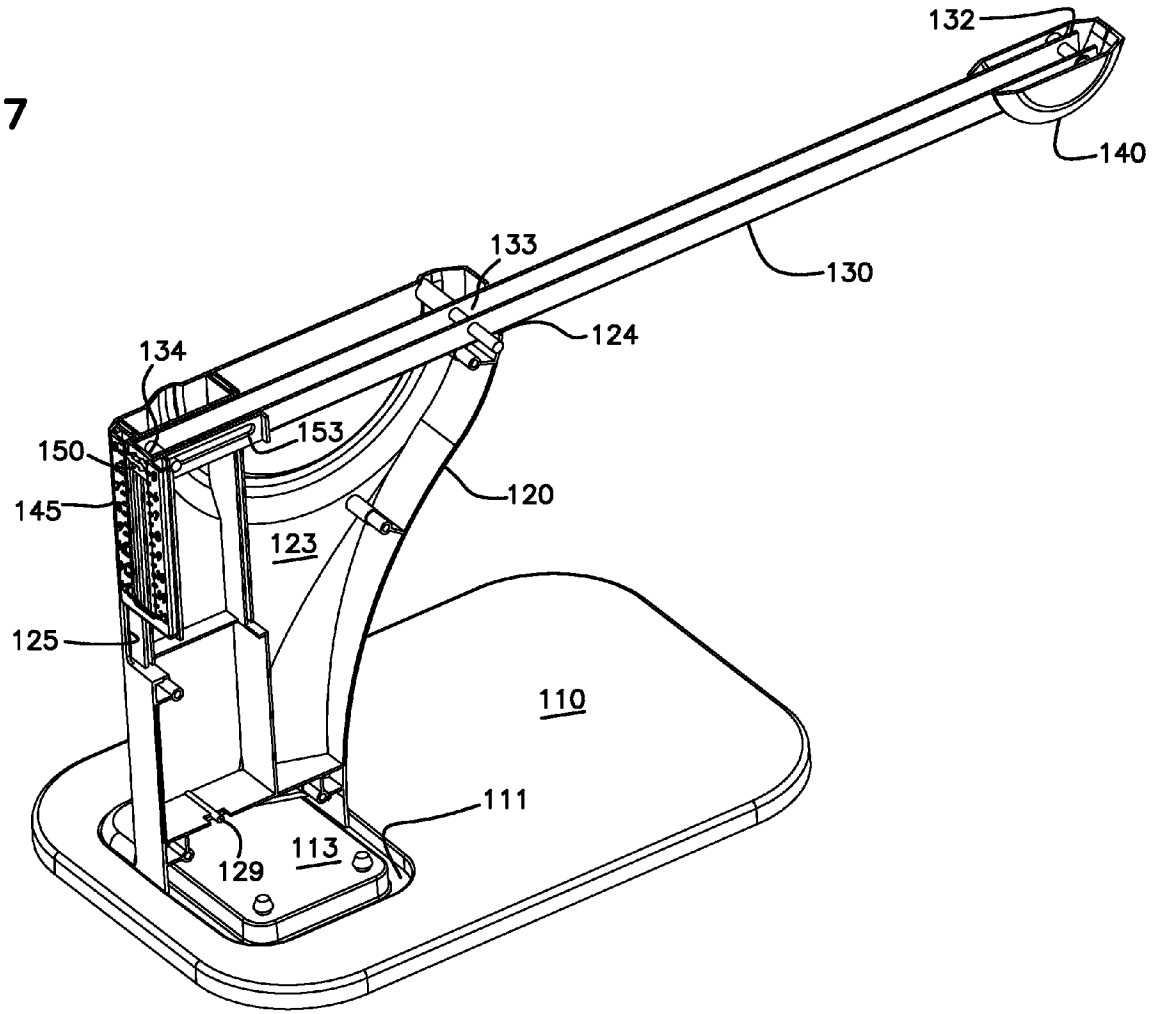
FIG. 7 is a cross-sectional view of the trunk lift device of FIG. 1 taken along the 7-7 line of FIG. 2.
Figure 8:
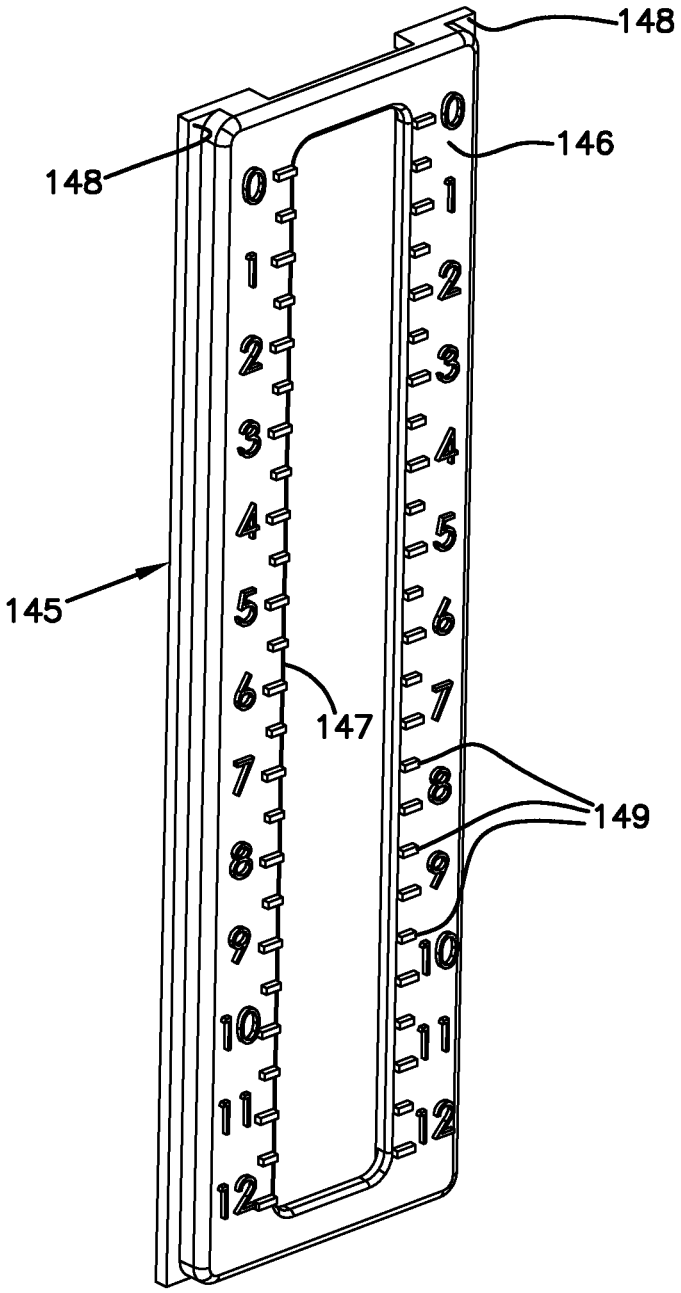
FIG. 8 is a perspective view of an example gauge suitable for use with the trunk lift device of FIG. 1.

As shown in FIGS. 7-8, the gauge 145 is disposed at the rear 102 of the tower 120. In some implementations, the tower 120 defines a rear slot 125 at which the gauge 145 is coupled to the tower 120. In some implementations, the gauge 145 has a body 146 defining a slot 147 extending along a length of the body 146. Position markers 149 are disposed on the body 146 at a side of the slot 147. In the example shown, position markers are provided at both sides of the slot 147. At least some of the position makers 149 can be labeled (e.g., with numbers). In the example shown, the position markers 149 include raised bars and every other position marker 149 is labeled.

In some implementations, the gauge 145 is movable (e.g., slidable) relative to the tower 120. For examples, the gauge 145 can be movable along a length of the rear slot 125 in a first direction C1 or a second direction C2 (see FIG. 4). In certain implementations, the gauge 145 includes wings or flanges 148 extending outwardly from the body 146; the tower 120 defines a gauge guide channel 126 into which the wings 148 extend. In the example shown, the gauge guide channel 126 is disposed at opposite sides of the rear slot 125 (see FIG. 11). The wings 148 slide through the gauge guide channel 126 to enable the body 146 of the gauge guide 145 to move along the rear slot 125.

Figure 9:
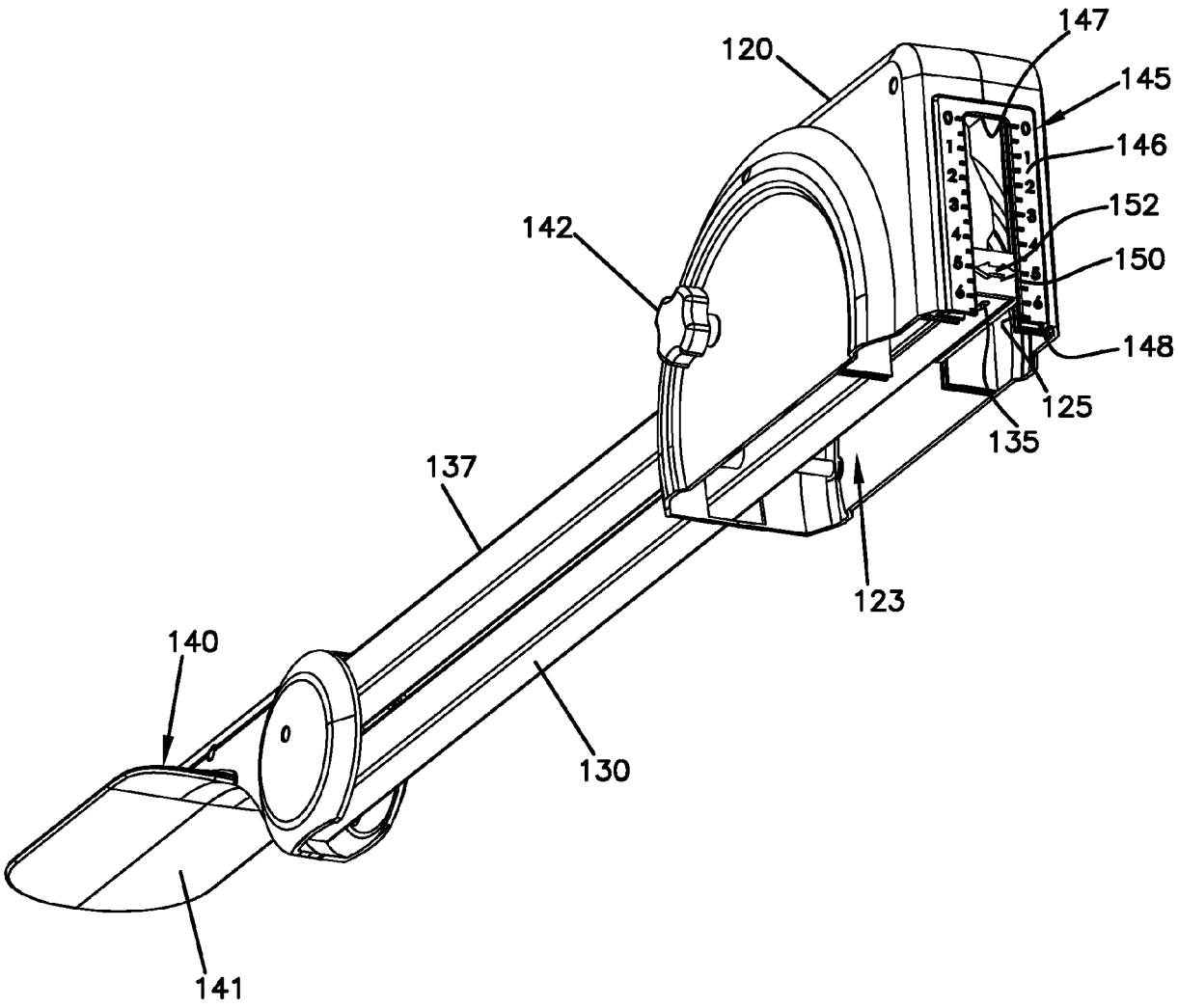
FIG. 9 is a cross-sectional view of the trunk lift device of FIG. 1 taken along a plane extending beneath a first arm so that a top of the trunk lift device of visible.
Figure 10:
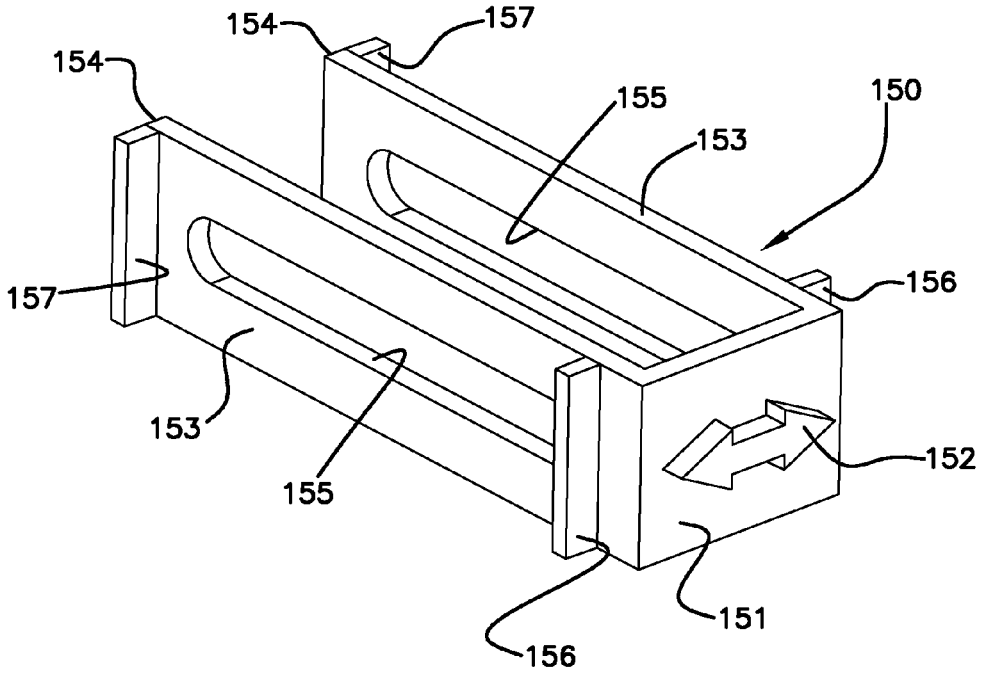
FIG. 10 is a perspective view of an example indicator suitable for use with the trunk lift device of FIG. 1.
Figure 11:
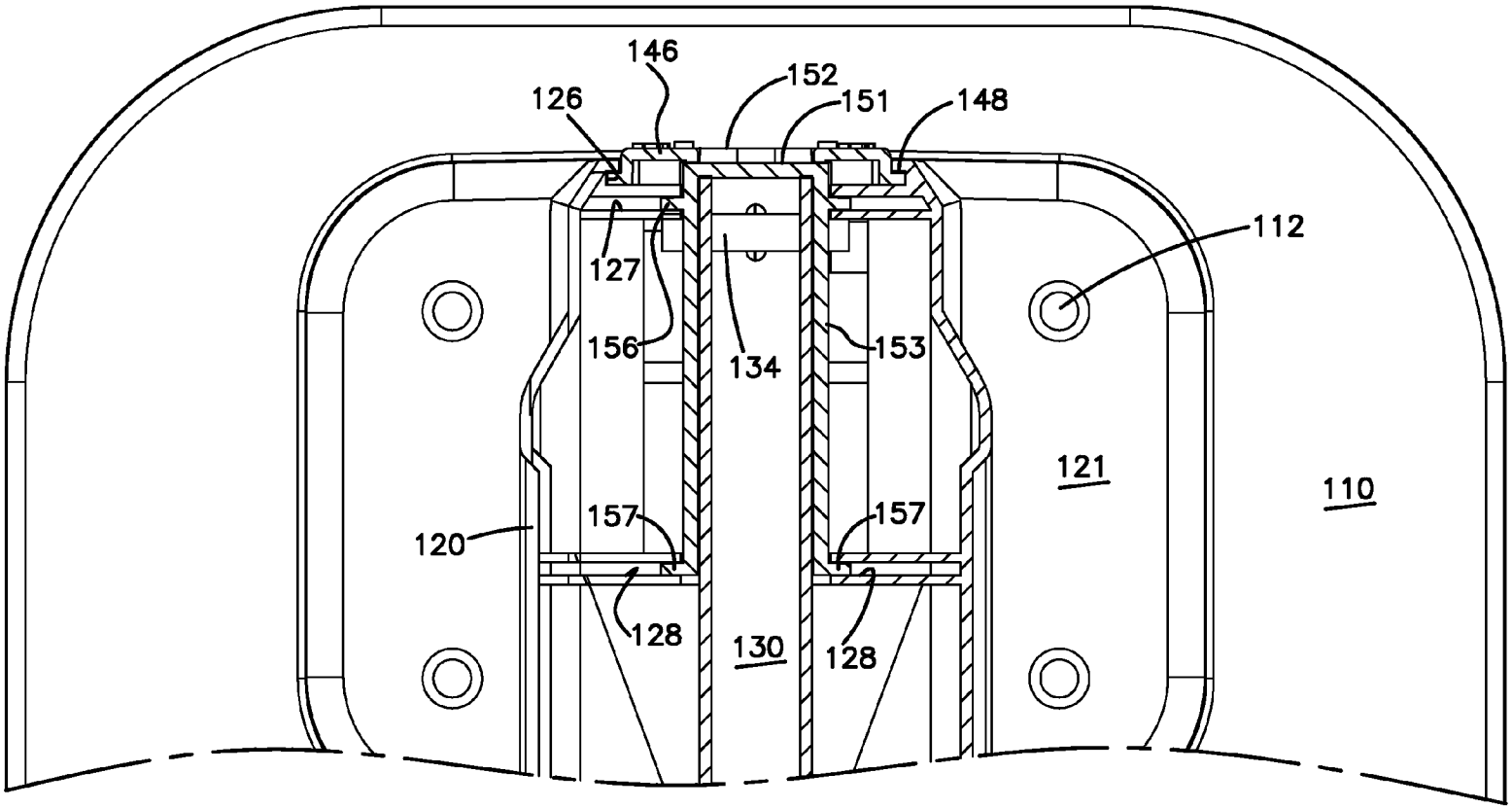
FIG. 11 is a cross-sectional view of the trunk lift device of FIG. 1 taken along the 11-11 line of FIG. 4.

As shown in FIGS. 9-11, the indicator 150 is coupled to the second end 132 of the first arm 130. Because the first arm 130 is coupled to the tower 120 at the intermediate portion 133, the first end 131 of the first arm 130 moves downwardly as the second end 132 moves upwardly and vice versa. Accordingly, movement of the push member 140 causes movement of the indicator 150. The indicator 150 includes a face 151 from which two extensions 153 extend to free ends 154. The face 151 is disposed in the slot 147 defined by the gauge body 147. An arrow 152 or other alignment indication is provided on the face 151 to align with position markers 149 provided by the gauge 145.

The position markers 149 on the gauge 145 are laid out so that movement of the arrow 152 along the gauge 145 measures a corresponding movement of the push member 140. For example, the position markers 149 may indicate inches, centimeters, or other distance dimension by which the movement of the push member 140 will be measured. In some implementations, the pivot axis $A_{P1}$ of the first arm 130 is defined through a center of the first arm 130 and movement of the indicator 150 directly corresponds to movement of the push member 140. In other implementations, however, the pivot axis $A_{P1}$ of the first arm 130 is offset from the center of the first arm 130 (e.g., see FIG. 5). In certain examples, the distance traveled by the indicator 150 is scaled down from the distance traveled by the push member 140. The position markers 149 are correspondingly scaled.

In some implementations, the gauge 145 can be calibrated for each user to account for differences in head size. In examples, one of the position markers 149 on the gauge 145 is labeled as "zero" position. When the push member 140 is aligned with the head of the user, the indicator 150 will be disposed at a location along the rear slot 125 of the tower 120. To calibrate the gauge 145, the gauge 145 is moved relative to the tower 120 to align the arrow 152 of the indicator 150 with the "zero" position marker 149 of the gauge 145. Accordingly, the movement of the indicator 150 occurring while the user performs a trunk lift will be measured from the same starting point on the gauge 145.

In some implementations, movement of the indicator 150 is limited by the length of the gauge slot 147. In such implementations, the body 146 of the gauge 145 inhibits further movement of the indicator 150 when the indicator 150 reaches a top or bottom of the indicator slot 147. Accordingly, the gauge body 146 functions as a limiter to inhibit overstretching of the user, which could lead to injury.

In some implementations, the gauge 145 extends vertically when disposed on the tower 120. Because the first arm 130 pivots relative to the tower 120, a constant distance is not maintained between the first end 131 of the first arm 130 and the gauge 145. In certain examples, the indicator 150 is pivotally coupled to the first arm 130 to enable the indicator face 151 to remain at the gauge 145. For example, the extensions 153 of the indicator 150 may define slots 155 that are elongated along a length of the extensions 153. A lateral bar 134 extends through the slots 155 and through the first end 131 of the first arm 130 to couple the indicator 150 to the first arm 130. The indicator 150 pivots relative to the first arm 130 about the lateral bar 134. As the first end 131 of the first arm 130 moves away from the gauge 145, the lateral bar 134 rides in the extension slots 155, thereby allowing the indicator face 151 to remain at the gauge slot 147. In other implementations, the gauge 145 may be curved to follow the first end 131 of the first arm 130.

As shown in FIG. 10, in some examples, the indicator 150 includes a first set of wings 156 that are configured to ride along a first indicator guide channel 127 (FIG. 11) defined by the tower 120. The first set of wings 156 facilitating aligning the indicator face 151 at the gauge slot 147 and maintaining alignment as the indicator 150 slides along the gauge 145. In certain examples, the wings 156 extend outwardly from the extensions 153 adjacent the indicator face 151. In certain implementations, the indicator 150 also includes a second set of wings 157 that are configured to ride along a second indicator guide channel 128 defined within the tower 120 (see FIG. 11). The second set of wings 157 also facilitate maintaining alignment between the indicator 150 and the gauge 145.

In some implementations, a resilient member 159 (FIG. 5) biases the first end 131 of the first arm 130 towards the base 110. In an example, the bias force is not sufficient to raise the push member 140 relative to the base 110 without an additional application of force to the push member 140. In an example, the bias force is sufficient to counter-act a weight of the arms 130, 137 and push member 140 to render the push member 140 relatively weightless to the user. Accordingly, the trunk-lift device 100 would measure how far the user can raise the user's trunk instead of how much weight the user can lift with their trunk. In certain examples, the resilient member 159 includes a coil spring. In an example, a first end of the resilient member 159 attaches to the lateral bar 134 at the first end 131 of the first arm 130 and a second end of the resilient member 159 attaches to a spring anchor bar 129 (FIG. 7) defined by the tower 120 and/or base 110. In the example shown, the first arm 130 defines an aperture 135 (FIG. 9) through which the resilient member 159 extends to connect to the lateral bar 134.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A trunk lift assessment device comprising:
a base configured to seat on a surface;
a tower extending upwardly from the base;
an arm extending between a first end and a second end, the arm having an intermediate portion disposed between the first end and the second end, the second end of the arm extending outwardly from the tower, the arm being configured to remain fixed relative to the tower when no external force is applied to the second end, the arm also being configured to pivot relative to the tower about a pivot axis when an external force is applied to the second end, the pivot axis extending through the intermediate portion of the arm;
a push member attached to the second end of the arm;
a gauge disposed at the tower, the gauge including a plurality of distance markers; and
an indicator coupled to the first end of the arm so that the indicator moves relative to the gauge when the arm is pivoted relative to the tower.

2. The trunk lift assessment device of claim 1, wherein the distance markers of the gauge include a starting position and wherein the distance markers increment as the gauge extends towards the base.

3. The trunk lift assessment device of claim 1, wherein the gauge is configured to move relative to the tower to adjust a relationship between the starting position and a starting distance between the push member and the surface.

4. The trunk lift assessment device of claim 3, wherein the gauge is configured to slide relative to the tower.

5. The trunk lift assessment device of claim 3, wherein the gauge limits a distance over which the indicator is able to travel during use, thereby limiting a distance the arm is able to pivot during use.

6. The trunk lift assessment device of claim 1, wherein the indicator is pivotally coupled to the first end of the arm.

7. The trunk lift assessment device of claim 6, wherein the first end of the arm includes a lateral bar, wherein the indicator defines a slot through which the lateral bar extends, wherein the indicator pivots relative to the first end of the arm about the lateral bar, and wherein the bar slides along the slot to enable the first end of the arm to pivot relative to the tower while enabling the indicator to slide relative to the tower.

8. The trunk lift assessment device of claim 6, wherein the indicator includes guide members that slide along a guide channel defined by the tower to guide the indicator as the indicator is moved relative to the tower.

9. The trunk lift assessment device of claim 1, further comprising a spring biasing the first end of the arm towards the base.

10. The trunk lift assessment device of claim 1, wherein the arm is a first arm, and further comprising a second arm extending outwardly from the tower generally parallel with the first arm.

11. The trunk lift assessment device of claim 10, wherein the second arm cooperates with the first arm to maintain an engagement surface of the push member generally horizontal.

12. The trunk lift assessment device of claim 10, wherein the second arm is pivotally coupled to the tower at a second pivot axis, wherein the pivot axis of the first arm is disposed forwardly of the second pivot axis of the second arm.

13. The trunk lift assessment device of claim 10, wherein a distance between the first arm and the second arm changes as the first arm and the second arm pivot relative to the tower.

14. The trunk lift assessment device of claim 10, further comprising a tensioning knob that enables adjustment of a tension force applied to the second arm to retain the first arm in position relative to the tower.

15. The trunk lift assessment device of claim 1, wherein the push member defines a flat bottom surface.

16. The trunk lift assessment device of claim 1, further comprising a stabilizer bar that extends outwardly from the base along the surface.

17. The trunk lift assessment device of claim 16, wherein the stabilizer bar extends generally parallel to the base.

18. The trunk lift assessment device of claim 1, wherein the tower is removably coupled to the base.

19. The trunk lift assessment device of claim 1, wherein the arm extends outwardly from a front of the tower and the gauge is disposed at a rear of the tower.

20. A method of assessing a trunk lift using a trunk lift assessment device, the method comprising:
pivoting an arm relative to a tower until a push member coupled to the arm aligns with a top of a head of a user that is lying prone on a surface;
moving a gauge relative to the tower until an indicator coupled to the arm aligns with a zero position marker on the gauge;
instructing the user to perform a trunk lift so that the head of the user pushes the push member away from the surface, thereby causing the arm to pivot relative to the tower and thereby causing the indicator to move relative to the gauge;
allowing the user to move the head of the user back towards the surface; and
determining a position marker of the gauge with which the indicator aligns.

21. The method of claim 20, further comprising:
providing a stabilizer bar extending outwardly from a base to which the tower is coupled; and
positioning a mat over the stabilizer bar adjacent the base, the mat defining the surface on which the user is lying prone.

* * * * *